US007589270B2

(12) United States Patent
Tohgi et al.

(10) Patent No.: US 7,589,270 B2
(45) Date of Patent: Sep. 15, 2009

(54) MUSICAL CONTENT UTILIZING APPARATUS

(75) Inventors: Yutaka Tohgi, Hamakita (JP); Ken'ichi Yamauchi, Hamamatsu (JP); Toshihisa Sadakata, Hamamatsu (JP); Gary Gregson, London (GB)

(73) Assignee: Yamaha Corporation, Hamamatsu (JP)

( * ) Notice: Subject to any disclaimer, the term of this patent is extended or adjusted under 35 U.S.C. 154(b) by 0 days.

(21) Appl. No.: 12/041,597

(22) Filed: Mar. 3, 2008

(65) Prior Publication Data

US 2008/0156172 A1 Jul. 3, 2008

Related U.S. Application Data

(62) Division of application No. 10/757,072, filed on Jan. 14, 2004, now Pat. No. 7,371,956.

(30) Foreign Application Priority Data

Jan. 14, 2003 (JP) ..... 2003-005339
Jan. 14, 2003 (JP) ..... 2003-005341
Jan. 14, 2003 (JP) ..... 2003-005343
Jan. 14, 2003 (JP) ..... 2003-005344

(51) Int. Cl.
*G10H 1/00* (2006.01)

(52) U.S. Cl. ..... 84/600; 84/601; 715/201

(58) Field of Classification Search ..... 84/600–602; 715/201

See application file for complete search history.

(56) References Cited

U.S. PATENT DOCUMENTS 5,690,496 A 11/1997 Kennedy
5,864,868 A 1/1999 Contois
6,078,005 A 6/2000 Kurakake et al.

(Continued)

FOREIGN PATENT DOCUMENTS

JP 11-175059 A 7/1999

(Continued)

OTHER PUBLICATIONS

Partial translation of relevant portion of Japanese Office Action issued in Japanese Patent Application No. 2003-005343, dated Apr. 24, 2007, which corresponds to the parent of the present application.

(Continued)

*Primary Examiner*—David S. Warren
(74) *Attorney, Agent, or Firm*—Rossi, Kimms & McDowell, LLP

(57) ABSTRACT

A musical content utilizing apparatus has a data input portion B11, transformation process portion B13 and utilization process portion B15 implemented via programmed processes. The data input portion B11 inputs musical content data comprising different kinds of content material data about music and content definition data defining the handling of the content material data. The transformation process portion B13 transforms the content definition data in accordance with stylesheets stored in a stylesheet storage portion B14 in order to enable the utilization process portion B15 to utilize the content material data. The utilization process portion B15 generates musical tones or displays images in accordance with the input content material, providing a user with musical content. As a result, a piece of musical content is able to be shared among various different types of musical content utilizing apparatuses, i.e., various platforms.

6 Claims, 6 Drawing Sheets

U.S. PATENT DOCUMENTS

| | | | | |
|---|---|---|---|---|
| 6,245,982 | B1 | 6/2001 | Suzuki et al. | |
| 6,423,893 | B1 * | 7/2002 | Sung et al. | 84/645 |
| 6,570,080 | B1 | 5/2003 | Hasegawa et al. | |
| 6,583,348 | B2 * | 6/2003 | Hasegawa et al. | 84/609 |
| 6,635,816 | B2 | 10/2003 | Funaki | |
| 6,660,922 | B1 | 12/2003 | Roeder | |
| 6,727,421 | B2 | 4/2004 | Izawa et al. | |
| 6,732,331 | B1 * | 5/2004 | Alexander | 715/234 |
| 6,740,803 | B2 | 5/2004 | Brinkman et al. | |
| 6,964,012 | B1 * | 11/2005 | Zirngibl et al. | 715/201 |
| 7,030,311 | B2 | 4/2006 | Brinkman et al. | |
| 7,062,437 | B2 * | 6/2006 | Kovales et al. | 704/260 |
| 7,081,580 | B2 | 7/2006 | Brinkman et al. | |
| 7,096,426 | B1 | 8/2006 | Lin-Hendel | |
| 7,345,234 | B2 * | 3/2008 | Plastina et al. | 84/615 |
| 7,358,434 | B2 * | 4/2008 | Plastina et al. | 84/615 |
| 7,394,473 | B2 * | 7/2008 | Asai | 345/679 |
| 7,423,214 | B2 | 9/2008 | Reynolds et al. | |
| 2001/0010049 | A1 * | 7/2001 | Otomo et al. | 707/500.1 |
| 2001/0039495 | A1 * | 11/2001 | Chin et al. | 704/500 |
| 2001/0044809 | A1 * | 11/2001 | Parasnis et al. | 707/513 |
| 2002/0020279 | A1 | 2/2002 | Funaki | |
| 2002/0029684 | A1 * | 3/2002 | Hasegawa et al. | 84/609 |
| 2002/0174150 | A1 * | 11/2002 | Dang et al. | 707/536 |
| 2003/0018607 | A1 * | 1/2003 | Lennon et al. | 707/1 |
| 2003/0140034 | A1 | 7/2003 | Probst et al. | |
| 2003/0182100 | A1 * | 9/2003 | Plastina et al. | 704/1 |
| 2003/0236792 | A1 * | 12/2003 | Mangerie et al. | 707/100 |
| 2004/0064500 | A1 * | 4/2004 | Kolar et al. | 709/202 |
| 2004/0103370 | A1 | 5/2004 | Chiang et al. | |
| 2005/0120866 | A1 | 6/2005 | Brinkman et al. | |
| 2005/0172786 | A1 * | 8/2005 | Plastina et al. | 84/600 |
| 2006/0018506 | A1 * | 1/2006 | Rodriguez et al. | 382/100 |
| 2006/0032362 | A1 | 2/2006 | Reynolds et al. | |
| 2006/0086234 | A1 * | 4/2006 | Jarrett et al. | 84/483.2 |
| 2006/0254407 | A1 * | 11/2006 | Jarrett et al. | 84/601 |
| 2008/0065976 | A1 * | 3/2008 | Kobayashi et al. | 715/201 |

FOREIGN PATENT DOCUMENTS

| | | | |
|---|---|---|---|
| JP | 11-341350 | A | 12/1999 |
| JP | 2001-024996 | A | 1/2001 |
| JP | 2001-100740 | A | 4/2001 |
| JP | 2002-032081 | A | 1/2002 |
| JP | 2002-073048 | A | 3/2002 |
| JP | 2002-217922 | A | 8/2002 |
| JP | 2002-073040 | A | 3/2003 |

OTHER PUBLICATIONS

Translation of relevant portion of Japanese Office Action dated Mar. 14, 2006, issued in Japanese application JP2003-5339 which corresponds to the parent of the present application.

Translation of relevant portion of Japanese Office Action dated Feb. 21, 2006, issued in Japanese application JP2003-5341 which corresponds to the parent of the present application.

Translation of relevant portion of Japanese Office Action dated Feb. 21, 2006, issued in Japanese application JP2003-5344 which corresponds to the parent of the present application.

* cited by examiner

MUSICAL CONTENT UTILIZING APPARATUS

This is a divisional of U.S. patent application Ser. No. 10/757,072 filed Jan. 14, 2004.

BACKGROUND OF THE INVENTION

1. Field of the Invention

The present invention relates to a musical content utilizing apparatus and a computer program applied to the apparatus, the musical content utilizing apparatus inputting different kinds of content material data about music and providing users with musical information through the use of the input content material data.

2. Description of the Related Art

Conventionally, there has been a musical content utilizing apparatus which provides users with musical content, reproducing musical content comprising music data (e.g., MIDI data), moving image data (motion image data), etc. (Japanese Laid-Open No. H11-341350 (U.S. Pat. No. 6,078,005)). The conventional apparatus is designed such that a reproduction controlling tool for controlling the reproduction made by a sequencer is displayed on a display screen, the reproduction controlling tool being formed by the elements of start, stop, fast-forward, and fast-reverse. The reproduction controlling tool is operated by a mouse click, and the reproduction of a performance made by the sequencer is controlled in accordance with the mouse operation.

However, since the above conventional musical content is created in accordance with a format specifically designed for each musical content utilizing apparatus, there is a problem that a piece of musical content cannot be shared among a different variety of platforms, such as electronic musical instruments and personal computers. Even among utilizing apparatuses of the same type, a piece of musical content cannot be shared if devices incorporated into the utilizing apparatuses vary in feature such as the size, shape or resolution of a display unit. That is, a piece of musical content cannot be shared among different types of platforms.

In addition, some of the conventional musical content utilizing apparatuses employ plug-ins for incorporating an additional capability. For example, a MIDI-capable apparatus can incorporate a plug-in program which enables the MIDI apparatus to reproduce moving image data. However, there is another problem that when a conventional musical content utilizing apparatus has a plurality of plug-in programs having the same capability, the conventional apparatus is unable to utilize the plug-in programs in an appropriate manner.

Moreover, a reproduction controlling tool of the conventional musical content utilizing apparatus cannot be put to effective use because the reproduction controlling tool of the conventional apparatus is used fixedly for the control of the reproduction made by a sequencer. In other words, the reproduction controlling tool of the conventional apparatus cannot be switchable to support various uses such as selectively controlling the reproduction of various content materials and synchronously reproducing a plurality of content materials.

Furthermore, since the above conventional musical content is created in accordance with a format specifically designed for each musical content utilizing apparatus, a piece of musical content cannot be shared among different types of platforms such as electronic musical instruments and personal computers. Even among electronic musical instruments, a piece of musical content cannot be shared if display units of the electronic musical instruments vary in size. That is, a piece of musical content cannot be shared among different types of platforms. Examples of such cases include a case in which some platforms are capable of reproducing moving images, but others are not. In such cases, there is no use supplying all the input content material data to a utilization portion. Worse yet, the supplied data can disrupt processing in the utilization portion.

SUMMARY OF THE INVENTION

The present invention was accomplished to solve the above-described problems, and an object thereof is to provide a musical content utilizing apparatus and a computer program applied to the apparatus, the musical content utilizing apparatus capable of sharing a piece of musical content among various different kinds of platforms.

The object of the present invention also lies in providing a musical content utilizing apparatus and a computer program applied to the apparatus, the musical content utilizing apparatus being able to utilize an appropriate plug-in program at all occasions.

The object of the present invention also lies in providing a musical content utilizing apparatus and a computer program applied to the apparatus, the musical content utilizing apparatus being capable of variously controlling the reproduction of a plurality of content materials through the effective use of a reproduction controlling tool displayed on a display unit.

In addition, the object of the present invention lies in providing a musical content utilizing apparatus and a computer program applied to the apparatus, the musical content utilizing apparatus eliminating the above-described uselessness and making efficient use of input content materials without disrupting the use of content material data.

In order to achieve the above-described object, a feature of the present invention lies in a musical content utilizing apparatus providing a user with musical content, the musical content utilizing apparatus inputting musical content data comprising different kinds of content material data about music and content definition data defining the handling of the content material data, providing a user with musical information through the use of the input content material data, and transforming the input content definition data in order to make the content material data applicable.

In this case, for example, the content definition data may be transformed in accordance with a stylesheet which is stored in a stylesheet storage portion and defines a transformation rule. Further, the stylesheet may include data defining a display layout on the display unit of a content material represented by the content material data, so that the display layout on the display unit of the content material is controlled on the basis of the data defining the display layout. Moreover, the content definition data may be described in XML format, for example, while examples of the stylesheets include XSLT stylesheets. The stylesheets may be also described in CSS, Cascading Style Sheet.

In the present invention described above, since content definition data is automatically transformed in the musical content utilizing apparatus in order to make content material data applicable, various different types of musical content utilizing apparatuses (i.e., various platforms) can share a piece of musical content if each type of the musical content utilizing apparatuses is provided with a transforming capability (transformation process and stylesheets). Moreover, since there is eliminated the need for preparing various different kinds of specifically-designed musical content data in order to satisfy various types of musical content utilizing apparatuses, making diverse kinds of musical content data is made relatively easy.

Another feature of the present invention is to make the stylesheet upgradable. According to the feature, even if specifications of a platform has been modified (e.g., software upgrade), the upgradability of the stylesheet ensures that musical content is applicable to the musical content utilizing apparatus in an easy and appropriate manner.

A further feature of the present invention lies in the musical content utilizing apparatus providing a user with musical content, the musical content utilizing apparatus inputting musical content data comprising different kinds of content material data about music and content definition data containing plug-in designation data designating a plug-in program required on utilizing the content material data, and providing a user with musical information based on the input content material data through the use of the plug-in program designated in accordance with the plug-in designation data contained in the input content definition data.

According to the above-described feature, even in the cases where the musical content utilizing apparatus is provided with various plug-in programs, the musical content utilizing apparatus can easily utilize an appropriate plug-in program as far as content definition data contains plug-in designation data designating a plug-in program to be used at the use of content material data. As a result, musical information based on content material data is appropriately delivered to a user.

Still a further feature of the present invention is to contain in content definition data a plug-in parameter used at the use of a plug-in program, so that the musical content utilizing apparatus can provide a user with musical information based on content material data input through the use of the plug-in parameter.

According to the above-described feature, musical information based on the content material data is able to be delivered to the user in an easy and appropriate manner just by providing musical content data with a parameter indicative of details of the plug-in program.

Another feature of the present invention lies in the musical content utilizing apparatus having a display unit and providing a user with musical content, the musical content utilizing apparatus inputting musical content data including different kinds of content material data about music, displaying concurrently different kinds of content materials represented by the input different kinds of content material data on the display unit while displaying on the display unit a reproduction controlling tool for controlling the reproduction of the content materials, and designating, from among the different kinds of content materials displayed on the display unit, a content material whose reproduction is to be controlled by the reproduction controlling tool.

At this designation, for example, a content material to be controlled by the reproduction controlling tool may be designated on the basis of user's operation on operators. Alternatively, musical content data may contain content definition data designating a content material to be controlled by the reproduction controlling tool so that the content material to be controlled by the reproduction controlling tool can be designated on the basis of the content definition data.

According to the above-described feature, a content material to be controlled by the reproduction controlling tool displayed on the display unit is selected by user's operation or selected automatically. Therefore, the designation of a content material to be controlled by a reproduction controlling tool facilitates selective control of reproduction of a content material. At this designation of a content material, one or more content materials may be designated as being controlled by a reproduction controlling tool. When a plurality of content materials are designated, the content materials are reproduced concurrently, resulting in the usability of the musical content utilizing apparatus being improved.

An additional feature of the present invention lies in the musical content utilizing apparatus having a display unit and providing a user with musical content, the musical content utilizing apparatus inputting musical content data comprising different kinds of content material data about music and content definition data including a material displaying instruction for displaying on the display unit content materials represented by the different kinds of content material data and a tool displaying instruction for displaying on the display unit a reproduction controlling tool for controlling the reproduction of the content materials, and displaying on the display unit the different kinds of content materials represented by the different kinds of content material data input on the basis of the material displaying instruction included in the content definition data while displaying on the display unit the reproduction controlling tool on the basis of the tool displaying instruction included in the content definition data.

At this display, for example, content definition data may also include a content designating instruction designating a content material with which a reproduction controlling tool is displayed in corresponding relation to the tool displaying instruction, so that the reproduction controlling tool is displayed in corresponding relation to the content material designated by the content designating instruction.

According to the above-described feature, the automatic selection of content material to be controlled by a reproduction controlling tool displayed on a display unit is achieved just by including, in content definition data, a material displaying instruction and a tool displaying instruction, resulting in the selective control over reproducing a content material being easily achieved. At this selection of content material, one or more content materials may be controlled by a reproduction controlling tool. When a plurality of content materials are controlled, the content materials are reproduced concurrently, resulting in the usability of the musical content utilizing apparatus being improved.

An even further feature of the present invention lies in the musical content utilizing apparatus having a display unit and providing a user with musical content, the musical content utilizing apparatus inputting musical content data comprising different kinds of content material data about music and content definition data including a material displaying instruction for displaying on the display unit content materials represented by the different kinds of content material data and a synchronous content reproducing instruction for designating content materials to be synchronously reproduced, and displaying on the display unit the different kinds of content materials represented by the input different kinds of content material data on the basis of the material displaying instruction included in the content definition data while displaying on the display unit a reproduction controlling tool for controlling the synchronous reproduction of the content materials designated by the synchronous content reproducing instruction included in the content definition data.

At this display, the content definition data may also include a reproduction controlling tool instruction for displaying on the display unit the reproduction controlling tool so that the reproduction controlling tool is displayed in accordance with the reproduction controlling tool instruction.

According to the above-described feature, just by including in the content definition data a material displaying instruction and a synchronous content reproducing instruction, the synchronous control over a plurality of content materials by a reproduction controlling tool is achieved in an easy manner, improving the usability of the musical content utilizing apparatus.

Another feature of the present invention lies in the musical content utilizing apparatus providing a user with musical content, the musical content utilizing apparatus inputting musical content data including different kinds of content material data, filtering the input different kinds of content material data in order to extract applicable content material data from among the different kinds of content material data, and providing a user with musical information through the use of the content material data extracted by the filtering.

At this filtering, a stylesheet defining applicable content material data may be stored in the musical content utilizing apparatus, so that the input different kinds of content material data is filtered in accordance with the stylesheet.

According to the above-described feature, even when content materials capable of being shared among different kinds of platforms are input to the musical content utilizing apparatus, the musical content utilizing apparatus extracts only content materials applicable thereto in order to deliver to a user, resulting in the efficient use of input content materials being achieved.

A further feature of the present invention lies in the musical content utilizing apparatus in which the stylesheets are upgradable. According to the feature, even when specifications of a platform are modified (e.g., when software is upgraded), the upgradability of the stylesheets ensures the efficient use of input content materials.

DESCRIPTION OF THE PREFERRED EMBODIMENT

Figure 1:
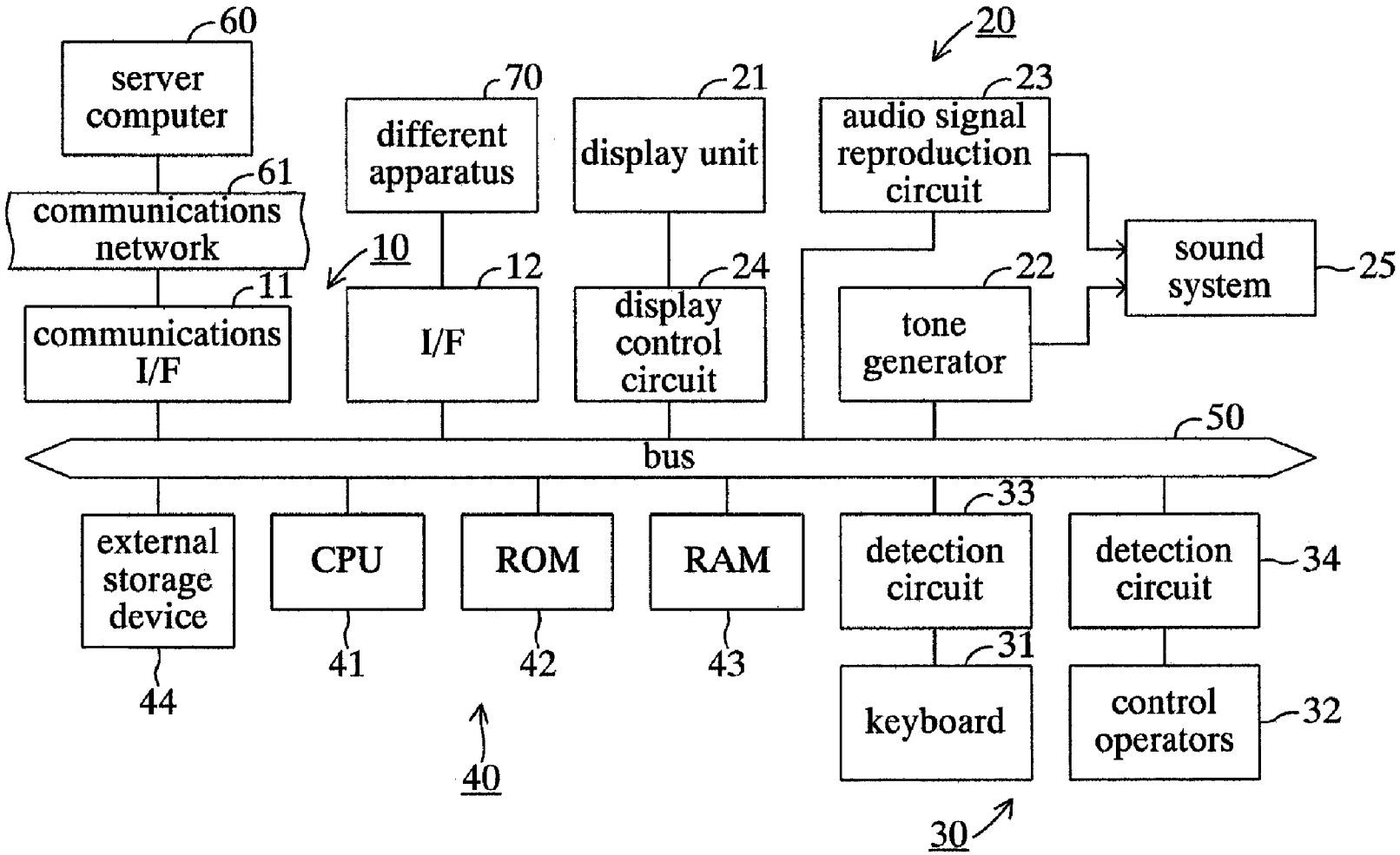
FIG. 1 is a block diagram showing the whole of a musical content utilizing apparatus according to an embodiment of the present invention.

An embodiment of the present invention will now be described with reference to the drawings. FIG. 1 is a block diagram showing the whole of a musical content utilizing apparatus having a form of an electronic musical instrument according to the embodiment. The musical content utilizing apparatus comprises an input portion 10 for inputting musical content, a utilization portion 20 for utilizing the musical content, an operation portion 30 operated by a user in order to instruct operations of the musical content utilizing apparatus, and a computer main unit portion 40 program-controlling the input portion 10, utilization portion 20 and operation portion 30.

The input portion 10 has a communications interface circuit 11 and an interface circuit 12 connected to a bus 50. The communications interface circuit 11 is connected to a server computer 60 via a communications network 61 in order to enable the server computer 60 to send and receive various programs and data. The interface circuit 12 is connected to a different apparatus 70 in order to enable the musical content utilizing apparatus to send and receive various programs and data to/from the different apparatus 70.

The utilization portion 20 has a display unit 21, tone generator 22 and audio signal reproduction circuit 23. The display unit 21, which is configured by a CRT display unit, liquid crystal display, etc., is controlled by a display control circuit 24 connected to the bus 50 in order to visualize various information. The tone generator 22, which is connected to the bus 50, forms musical tone signals based on performance information (key code, key-on signal, key-off signal, tone color control information, etc.) as musical content supplied through the bus 50 and outputs the formed musical tone signals. The audio signal reproduction circuit 23, which is also connected to the bus 50, reproduces audio data as musical content supplied through the bus 50 and outputs audio signals. To the tone generator 22 and audio signal reproduction circuit 23 there is connected a sound system 25 which includes amplifiers, speakers, etc. The sound system 25 emits tones corresponding to the musical tone signals supplied from the tone generator 22 and the audio signals from the audio signal reproduction circuit 23.

The operation portion 30 has a keyboard 31 and control operators 32. The keyboard 31, which comprises a plurality of keys supporting a given range, is used for performance of music pieces. The control operators 32 comprise a plurality of operators used for instructing operations of the musical content utilizing apparatus. The control operators 32 include cursor-movement keys (including a mouse, track ball, etc.), mode-selection keys for specifying various operational modes, instruction-input keys for inputting user's instruction, etc. The cursor is displayed on the display unit 21. The keyboard 31 may be used as the cursor-movement, mode-selection and instruction input keys. Operations of the keyboard 31 and control operators 32 are detected by detection circuits 33 and 34, respectively. The detection circuits 33 and 34 are also connected to the bus 50.

The computer main unit portion 40 comprises a CPU 41, ROM 42, RAM 43 and external storage device 44 which are connected to the bus 50. The CPU 41, ROM 42 and RAM 43 are used for executing various programs transferred from the external storage device 44 to the RAM 43 in order to control the input portion 10, utilization portion 20 and operation portion 30.

The external storage device 44 comprises a previously equipped storage medium such as a hard disk HD, detachable storage media such as a flexible disk FD and compact disk CD, and drive units enabling the above storage media to read and write programs and data. To the external storage device 44 there is downloaded musical content of the present invention. Also previously stored in the external storage device 44 are fundamental control programs and control data for controlling basic operations of the musical content utilizing apparatus. The fundamental control programs include a musical content utilization program substantially including a browser, detection program for detecting operations of the keys and operators, and tone generation control program. The fundamental control programs and control data can be downloaded from the server computer 60 or different apparatus 70.

In the external storage device 44 there are also previously stored stylesheets and plug-in programs necessary to reproduce input musical content. The stylesheets and plug-in programs are allowed to be upgraded as required. The stylesheets define musical content applicable to the utilization portion 20, comprising a group of data which defines format transformation for making the input musical content data applicable to the utilization portion 20. Examples of the stylesheets include XSLT stylesheets for transforming XML-compliant musical content data such that a browser of the musical content utilizing apparatus can handle the musical content data. The XSLT stylesheets may be described in CSS, Cascading Style Sheet. Examples of the plug-in programs, which enable the utilization portion 20 to use the input musical content data, include a musical score display program for displaying musical scores on the display unit 21, a video program for playing back videos on the display unit 21, a point grading program for grading performances on the keyboard 31, and an automatic performance program for automatically performing music pieces through the use of the tone generator 22.

Next explained will be details of utilizing musical content on the musical content utilizing apparatus configured as described above. First, a user starts the musical content utilization program substantially including a browser. The start-up of the musical content utilization program causes the musical content utilizing apparatus shown in FIG. 1 to start delivering functions shown in a functional block diagram of FIG. 2. That is, the functional block diagram illustrates functions performed by executing programs stored in the external storage device 44, the functions being performed by both hardware and software. In other words, FIG. 2 illustrates the details of the processes done by the programs executed on the hardware configuration shown in FIG. 1.

Figure 2:
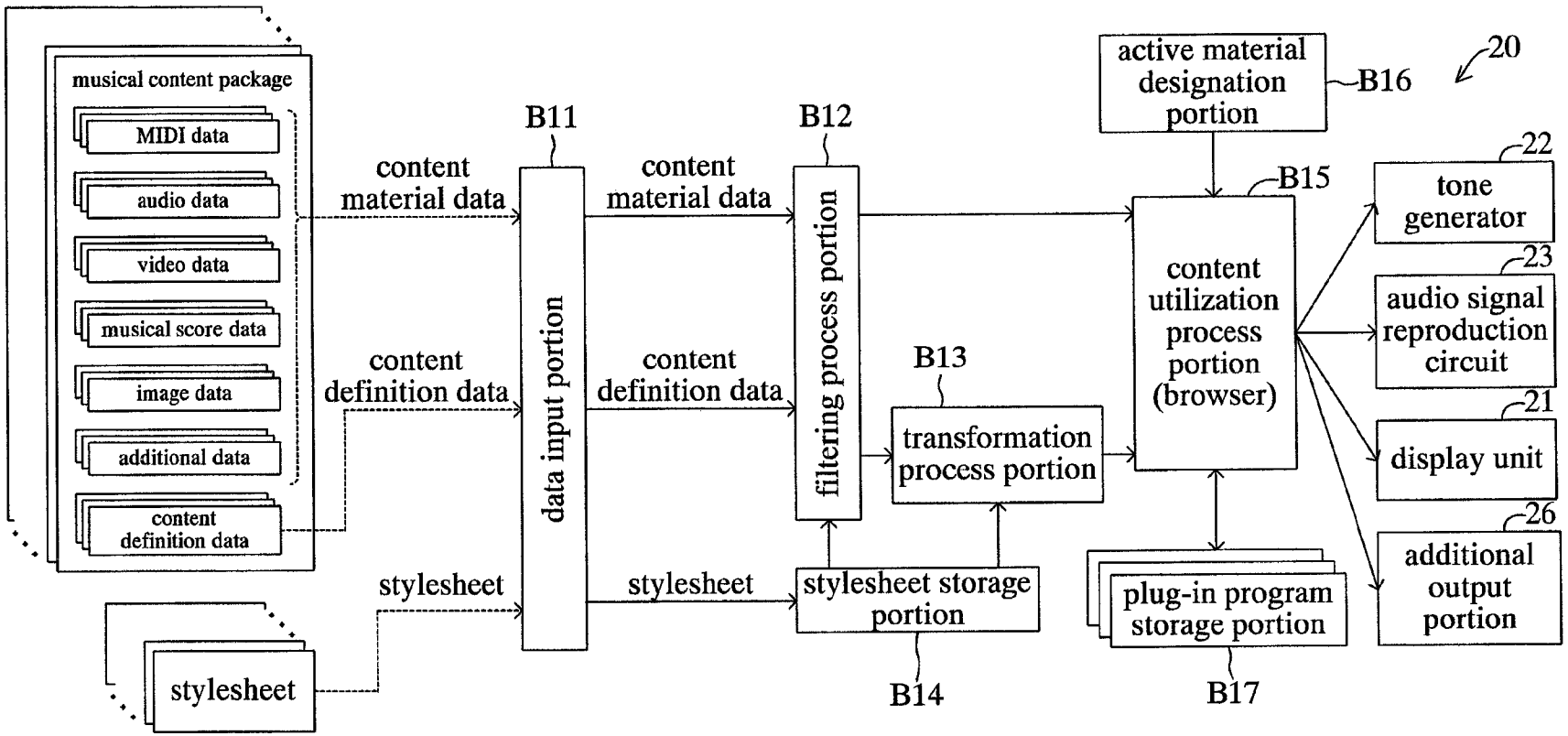
FIG. 2 is a block diagram showing functions of the musical content utilizing apparatus shown in FIG. 1, the functions being realized by a computer program.

As shown in FIG. 2, the musical content utilizing apparatus inputs musical content data at a data input portion B11. The data input portion B11 corresponds to a process to retrieve musical content data stored in the server computer 60 into the external storage device 44 in accordance with a user's operation on the control operators 32. At the user's operation, the user instructs retrieval of musical content data in accordance with a browser screen displayed on the display unit 21.

Now, details of the musical content data will be described. The musical content data is the data previously stored in the server computer 60, being available by package. A musical content package contains different kinds of content material data and content definition data for one or more pages. For instance, a musical content package contains musical content for a music piece for training, while another musical content package containing musical content for training on a musical instrument. Examples of content material data contained in a musical content package include MIDI data comprising performance data, audio data comprising audio signals, video data comprising moving image data, musical score data representing a musical score, image data representing a static image, and additional data. A music content package may have either only a kind of content material data or various different kinds of content material data.

Figure 3:
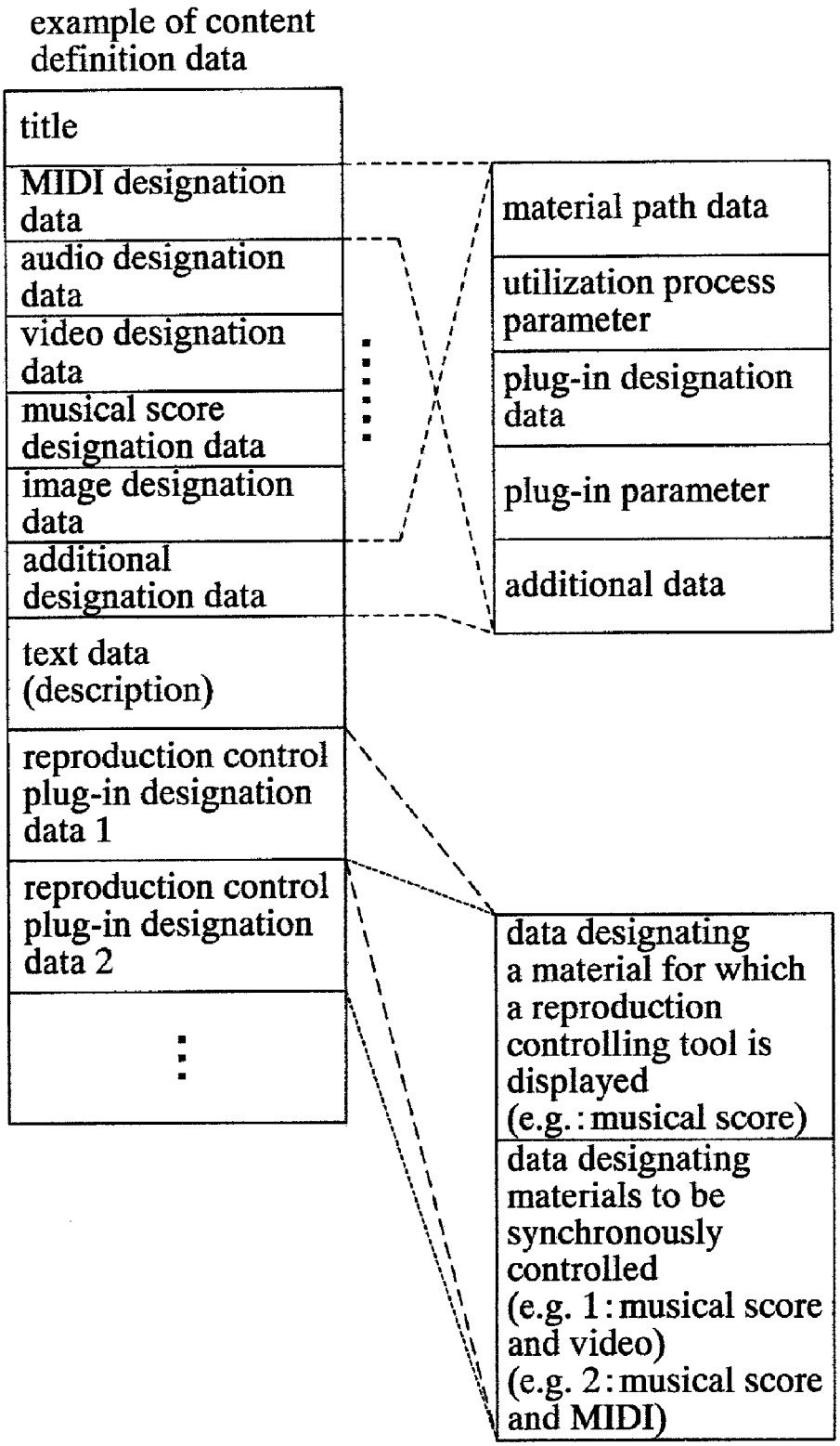
FIG. 3 is a diagram showing a format of content definition data.

As shown in FIG. 3, content definition data for a page comprises title data, different kinds of content material designation data, text data, and different kinds of reproduction control plug-in designation data. As an example, the content definition data is described in XML format. The title data represents the title of content.

The content material designation data, which is provided in corresponding relation to the aforementioned different kinds of content material data, is the data for defining the handling of each content material, the handling including designating a content material. Specifically, each of the content material designation data comprises path data ("path data" representing a path leading to a certain file or directory) for reading material data for designating a content material to be utilized, an utilization process parameter required for utilization of the material data, plug-in designation data for designating a plug-in program, a plug-in parameter required at startup of the plug-in program, and additional data. Examples of the utilization process parameters and plug-in parameters include the data representing the size of a displayed musical score, the size of a displayed video screen, the level of grading, etc.

The text data represents a description (e.g., description about a music piece, musical instrument, etc.) to be displayed on the display unit 21. The text data does not define details of the handling of a content material but is a content material itself. However, since the content definition data itself is formed by a text file in accordance with XML format, in the present embodiment, the description is included as text data in the content definition data.

The reproduction control plug-in designation data is provided in order to display on the display unit 21 reproduction controlling tools 21*f* and 21*g* (see FIG. 6) for controlling the reproduction of content materials through the use of a plug-in program stored in the external storage device 44 and to designate content materials to be controlled by the reproduction controlling tools 21*f* and 22*g*. Each of the reproduction control plug-in designation data comprises data for designating from among content materials displayed on the display unit 21 a content material to which the reproduction controlling tools 21*f* and 21*g* are displayed in corresponding relation, and data for designating one or more content materials to be controlled by the reproduction controlling tools 21*f* and 21*g*, respectively.

As for content material data contained in a musical content package, contained in a musical content package may be all types of the aforementioned data, namely, MIDI data, audio data, video data, musical score data, image data, and additional data. Alternatively, in a musical content package there may be contained only part of the types. As for content definition data as well, contained in a musical content package may be all types of the aforementioned data, namely, the title data, content material designation data, text data, and reproduction control plug-in designation data. Alternatively, in a musical content package there may be contained only part of the types. As for content material designation data as well, contained in a musical content package may be all types of the aforementioned data, namely, the path data, utilization process parameter, plug-in designation data, plug-in parameter and additional data. Alternatively, in a musical content package there may be contained only part of the types.

The content material data and content definition data which forms a musical content package and is retrieved into the data input portion B11 (i.e., the external storage device 44) as described above is supplied to a utilization process portion B15 in accordance with a user's operation on the control operators 32. On this supply, a filtering process portion B12 extracts only the data concerning content material data which has been defined by a stylesheet stored in a stylesheet storage portion B14 and is applicable to the utilization portion 20 of the musical content utilizing apparatus, and supplies the extracted data to the utilization process portion B15. That is, the filtering process portion B12 implements a filtering process on the content material data and content definition data to be supplied to the utilization process portion B15. More specifically, when a given type of content material data is not applicable to the utilization portion 20, the content material designation data on the inapplicable content material included in the content definition data is deleted so that the inapplicable content material data cannot be sent to the utilization process portion B15.

A transformation process portion B13 transforms the content definition data in accordance with transformation rules defined by the stylesheets stored in the stylesheet storage portion B14, and supplies the data to the utilization process portion B15. In other words, the transformation process portion B13 transforms the structure of the content definition data (in the present embodiment, the XML data structure) into a structure applicable to the utilization process portion B15 (in the present embodiment, a browser). The transformation process portion B13 also adds concrete items which are not defined in the content definition data in accordance with the stylesheets, or transforms items which are abstractly defined in the content definition data into concrete items in accordance with the stylesheets.

An example of the addition and transformation of the concrete items will be explained. The content definition data has no definition or only abstract definition of display layout of video and static images to be displayed on the display unit 21. Therefore, the transformation process portion B13 modifies video designation data, musical score designation data, image designation data, etc. in accordance with the size, shape, resolution, etc. of the display unit 21 of the musical content utilizing apparatus, and supplies the modified data to the utilization process portion B15 (a browser in the present embodiment).

More specifically, if content definition data is so abstract that images are merely displayed, and a specific plug-in program for displaying images on the display unit 21 is not designated, a plug-in program incorporated into the musical content utilizing apparatus for displaying images on the display unit 21 is designated. If content definition data does not designate concretely the position of video images, musical scores, static images, etc. to be displayed on the display unit 21, the display position is concretely designated in accordance with stylesheets. If content definition data does not define a font of characters to be displayed on the display unit 21 or defines the font only abstractly, the font of characters is designated concretely in accordance with stylesheets.

Next, processes and operations implemented by the utilization process portion B15 will be described. When the utilization process portion B15 receives the above-transformed content definition data, the utilization process portion B15 provides the user with information about various content materials in accordance with the received content definition data. In this case, if the utilization process portion B15 receives title data and text data included in the content definition data, information represented by the title data and text data is displayed on the display unit 21 in accordance with instructions transformed by the transformation process portion B13 through the use of the stylesheets (instructions transformed and added if there is an added instruction). Since the title data and text data does not include plug-in designation data and a plug-in parameter in ordinary cases, a browser included in a fundamental content utilization program is utilized.

When the utilization process portion B15 receives MIDI designation data, audio designation data, video designation data, musical score designation data, image designation data or additional designation data contained in the content definition data, the utilization process portion B15 retrieves appropriate content material data in the musical content package input to the data input portion B11, using material path data contained in the above designation data. The utilization process portion B15 then processes the input content material data and provides the user with musical information about the content material data, using the utilization portion 20.

In this case, when the content definition data contains plug-in designation data, a plug-in program stored in a plug-in program storage portion B17 and designated by the plug-in designation data is started, processing the above received content material data. When the content definition data does not contain plug-in designation data, a fundamental content utilization program substantially including a browser applicable to the utilization portion B15 processes the received content material data. Of course the content material data of this case designated by the content definition data is the data processible by the content utilization program. In addition, when the content definition data contains a utilization process parameter or plug-in parameter as well, these parameters are utilized for the process of the content material.

More specifically, when the content definition data is MIDI designation data, the utilization process portion B15 retrieves MIDI data designated by material path data contained in the musical content package input to the data input portion B11. The utilization process portion B15 then starts a plug-in program for reproduction of the MIDI data and orderly supplies pitch data, key-on data, key-off data, tone color control data, etc. which forms the MIDI data to the tone generator 22 in accordance with the progression of a music piece. The tone generator 22 then forms musical tone signals corresponding to the supplied data. As a result, musical tones corresponding to the formed musical tone signals are delivered to the user in an auditory way through the sound system 25.

When the content definition data is audio designation data, the utilization process portion B15 retrieves audio data designated by material path data contained in the musical content package input to the data input portion B11. The utilization process portion B15 then starts a plug-in program for audio reproduction and supplies tone data representative of audio signals (tones performed by musical instruments, choral tones, human voices, etc.) represented by audio data to the audio signal reproduction circuit 23 in accordance with the passage of time. The audio signal reproduction circuit 23 then reproduces the tone data. As a result, the reproduced tones such as tones performed by musical instruments, choral tones and human voices are delivered to the user through the sound system 25.

When the content definition data is video designation data, the utilization process portion B15 retrieves video data designated by material path data contained in the musical content package input to the data input portion B11. The utilization process portion B15 then starts a plug-in program for video reproduction and supplies moving image data representative of moving images represented by video data to the display unit 21 through the display control circuit 24. The display unit 21 then reproduces the moving images. As a result, the moving images represented by the video data are delivered to the user in a visual way.

When the content definition data is musical score designation data, the utilization process portion B15 retrieves musical score data designated by material path data contained in the musical content package input to the data input portion B11. The utilization process portion B15 then starts a plug-in program for display of a musical score and supplies image data corresponding to a musical score represented by the musical score data to the display unit 21 through the display control circuit 24. The display unit 21 then displays the musical score. As a result, the musical score displayed on the display unit 21 is delivered to the user in a visual way.

When the content definition data is additional designation data, the utilization process portion B15 retrieves additional data designated by material path data contained in the musical content package input to the data input portion B11. The utilization process portion B15 then starts an additional plug-in program, processes and supplies the additional data to an additional output portion 26 in order to deliver additional musical information to the user. The additional musical information includes instruction of keys to press on the keyboard 31 and point-grading of performance by a user.

As is apparent from the above description, the process at the transformation process portion B13 through the use of the stylesheets in a musical content utilizing apparatus transforms content definition data in order to enable the utilization process portion B15 and utilization portion 20 to utilize the content material data, resulting in a piece of musical content being able to be shared among various types of musical content utilizing apparatuses (i.e., various platforms). Moreover, since there is eliminated the need for preparing various different types of specifically-designed musical content data in order to satisfy various musical content utilizing apparatuses, making diverse kinds of musical content data is made relatively easy.

Figure 4A:
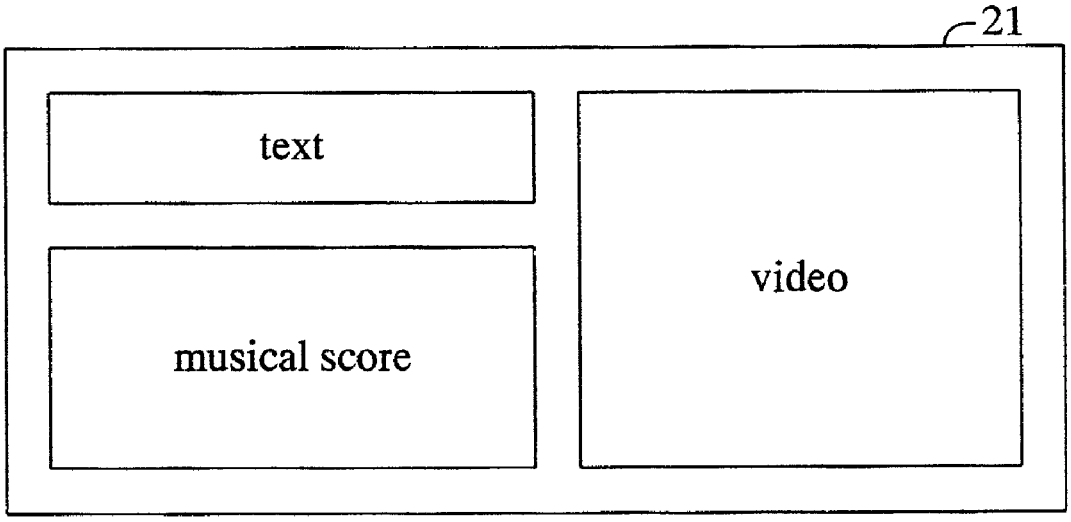
FIGS. 4(A) and (B) illustrate two different examples of a display unit shown in FIG. 1.

For example, as shown in FIGS. 4(A) and (B), even if sizes of areas to display text (description) and a musical score vary due to the difference in size of the display unit 21, the process to transform content definition data allows for free display layout of the display unit 21. Therefore, the musical content data is utilized efficiently, resulting in the utilization value of the musical content data being increased.

Figure 4B:
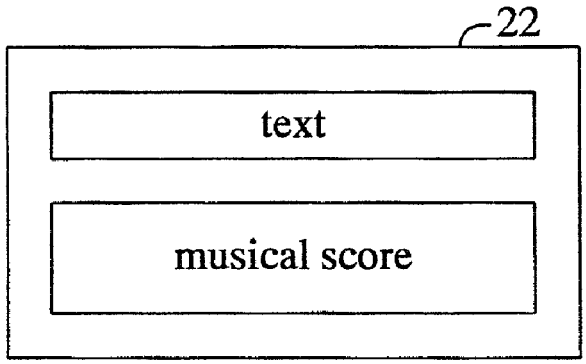

Moreover, video is available on a musical content utilizing apparatus capable of video-displaying on the display unit 21 as shown in FIG. 4(A). On the other hand, on a musical content utilizing apparatus incapable of video-displaying on the display unit 21 as shown in FIG. 4(B), video display is blocked by the transformation process. In this case, particularly, the filtering process through the use of stylesheets at the filtering process portion B12 prevents video-related data from being supplied to the utilization process portion B15, resulting in input content materials being utilized efficiently even in the cases where content materials and content designation data inapplicable to the musical content utilizing apparatus are included in the musical content package.

In addition, the above embodiment is adapted to be capable of writing stylesheets externally into the stylesheet storage portion B14. In other words, the stylesheets stored in the present musical content utilizing apparatus are adapted to be upgradable. Therefore, even in the cases where specifications of the musical content utilizing apparatus are modified (e.g., a case where a software version is upgraded), the upgradability of the stylesheet ensures that musical content is applicable to the musical content utilizing apparatus in an easy and appropriate manner.

In addition, the above embodiment is adapted to include, in content definition data, plug-in designation data designating a plug-in program to be executed at the use of content material data, so that the plug-in designation data along with content material data can be supplied to the musical content utilizing apparatus at the input of a musical content package. The musical content utilizing apparatus is also adapted to refer to the plug-in designation data to execute a plug-in program stored in the plug-in program storage portion B17. The plug-in program is used to deliver musical information based on the content material data to the user. Therefore, even in the cases where the musical content utilizing apparatus is provided with various plug-in programs, the musical content utilizing apparatus can easily utilize an appropriate plug-in program as far as content definition data contains plug-in designation data designating a plug-in program to be used at the use of content material data.

In the above embodiment, moreover, the content definition data is adapted to contain a plug-in parameter used at the use of a plug-in program so that the musical content utilizing apparatus can provide the user with musical information based on content material data input through the use of the plug-in parameter. Therefore, the above embodiment is capable of delivering musical information based on the content material data to the user in an easy and appropriate manner just by providing musical content data with a parameter representative of details of the plug-in program.

Figure 5A:
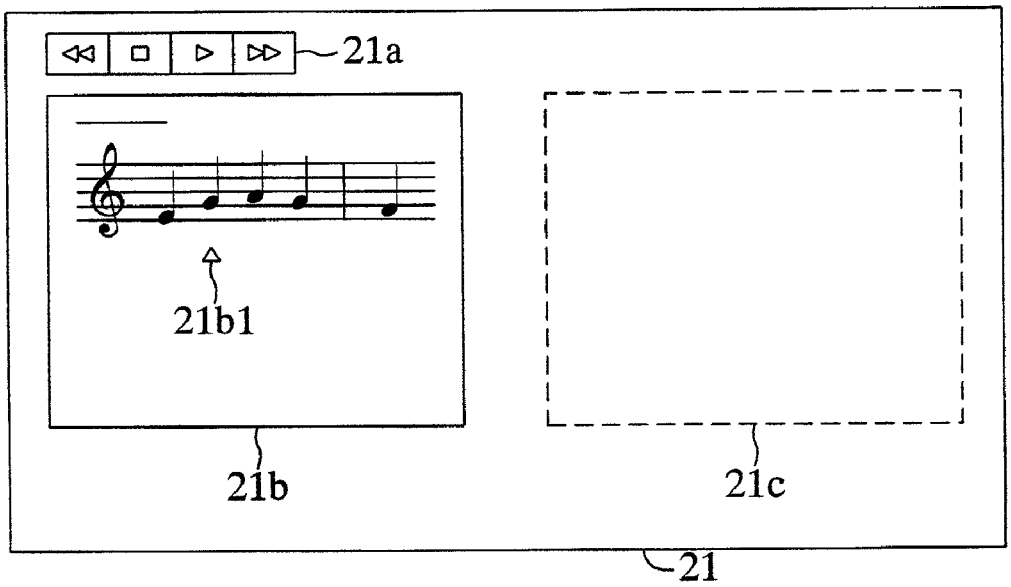
FIGS. 5(A) and (B) illustrate a screen of the display unit displaying a concrete example of musical content.

Next explained will be the details of utilizing content, in particular, a first and second utilization modes for utilizing musical content through the use of the reproduction controlling tools on the display unit 21. In the first utilization mode as shown in FIGS. 5(A) and (B), the reproduction controlling tool 21*a* is displayed on the screen of the display unit 21 through the use of a browser, the screen displaying a plurality of musical content materials. Examples of the musical content materials to be displayed on the display unit 21 in the present embodiment include a musical score based on musical score data and moving image based on video data. The reproduction controlling tool 21*a* comprises a plurality of elements for controlling fast-reverse, stop, replay, and fast-forward of a musical content material, the elements being arranged from left to right in the order of fast-reverse, stop, replay and fast-forward. Operations of the elements are instructed by a cursor moving on the screen through user's operation of the control operators 32.

Figure 5B:
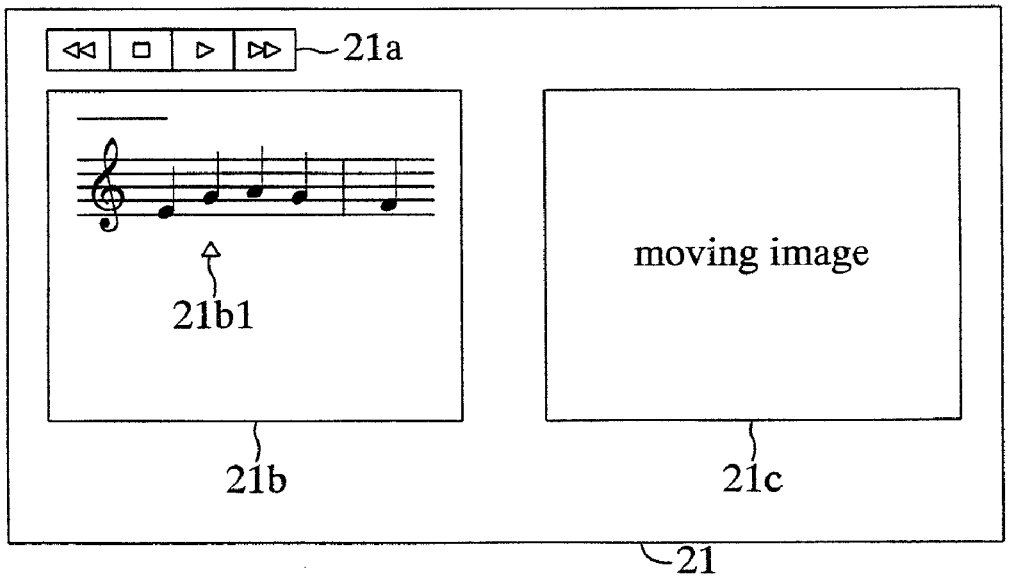

In the first utilization mode, one or more musical content materials arbitrarily selected from among a plurality of musical content materials are designated as being active by an active material designation portion B16 (see FIG. 2). The musical content materials designated as being active are to be controlled in accordance with the instructions given through the reproduction controlling tool 21*a*. For example, the active material designation portion B16, which corresponds to the control operators 32 in FIG. 1, enables a user to move a cursor toward a content material displayed on the display unit 21, allowing the user to click a mouse button to designate the material as being active. In FIG. 5(A) there is shown a state in which only a musical score 21*b* is designated as being active, while FIG. 5(B) shows a state in which the musical score 21*b* and a moving image 21*c* are designated as being active. In FIG. 5(A), the moving image 21*c* is kept standby. In a standby state, the whole or part (e.g., window frame) of the standby moving image 21*c* is not displayed or is displayed unobtrusively on the display unit 21. When the standby moving image 21*c* is not displayed, the musical score 21*b* may be displayed on the whole screen of the display unit 21. The display of the musical score 21*b* and moving image 21*c* is instructed on the basis of the musical score designation data and video designation data contained in the content definition data.

If an instruction of fast-reverse, stop, replay, or fast-forward is given by the reproduction controlling tool 21*a* during the state of FIG. 5(A), controlled to follow the instruction is only the musical score content material. When the instruction is given, a mark 21*b*1, for example, indicative of the current position of a music piece moves on the musical score in accordance with the instruction of fast-reverse, stop, replay, or fast-forward. In addition, when the display unit 21 displays only part of the musical score, the display unit 21 refreshes the screen of the musical score to be displayed in accordance with the progression of the music piece. On the other hand, the moving image 21*c* is kept in a state where the whole or part of the moving image 21*c* is not displayed or is displayed unobtrusively on the display unit 21, without being affected by the instruction of fast-reverse, stop, replay, or fast-forward. If a MIDI content material is designated as being active in the state of FIG. 5(A), the MIDI content material is also controlled by instructions from the reproduction controlling tool

21*a*, so that a performance of a music piece is controlled in accordance with the instructions of fast-reverse, stop, replay, or fast-forward.

When an instruction of fast-reverse, stop, replay, or fast-forward is given by the reproduction controlling tool 21*a* in the state of FIG. 5(B), not only the musical score content material (or musical score content material and MIDI content material) but also the moving image content material follow the instruction of fast-reverse, stop, replay, or fast-forward. That is, the musical score content material (or the musical score content material and MIDI content material) is controlled in synchronization with the moving image content material in accordance with the instruction of fast-reverse, stop, replay, or fast-forward given by the reproduction controlling tool 21*a*.

In the above description, a content material to be designated as being active is indicated by the active material designation portion B16 (the control operators 32), but the designation of a content material may be done in accordance with an input musical content package. In this case, content definition data in the musical content package may contain data indicating a content material to which instructions of fast-reverse, stop, replay, or fast-forward by the reproduction controlling tool 21*a* are directed, so that the utilization portion B15 can indicate the content material to be designated as being active in an initial state on the basis of the data indicative of the active content material. Other materials may be designated as being active by user's instruction later on.

In the above-described designation of active content materials, content materials to be controlled by the reproduction controlling tool 21*a* which is displayed on the display unit 21 and used for controlling reproduction of a plurality of content materials in common are selected by user's operation or selected automatically. Therefore, the designation of active content materials facilitates selective control of reproduction of content materials, improving the usability of the musical content utilizing apparatus.

Next, the second utilization mode of the reproduction controlling tool will be explained. In the second utilization mode, reproduction control plug-in designation data contained in the content definition data is used for designating a content material for which the reproduction controlling tool is displayed and a content material which is to be controlled by the displayed reproduction controlling tool in synchronization with the aforementioned content material.

Figure 6A:
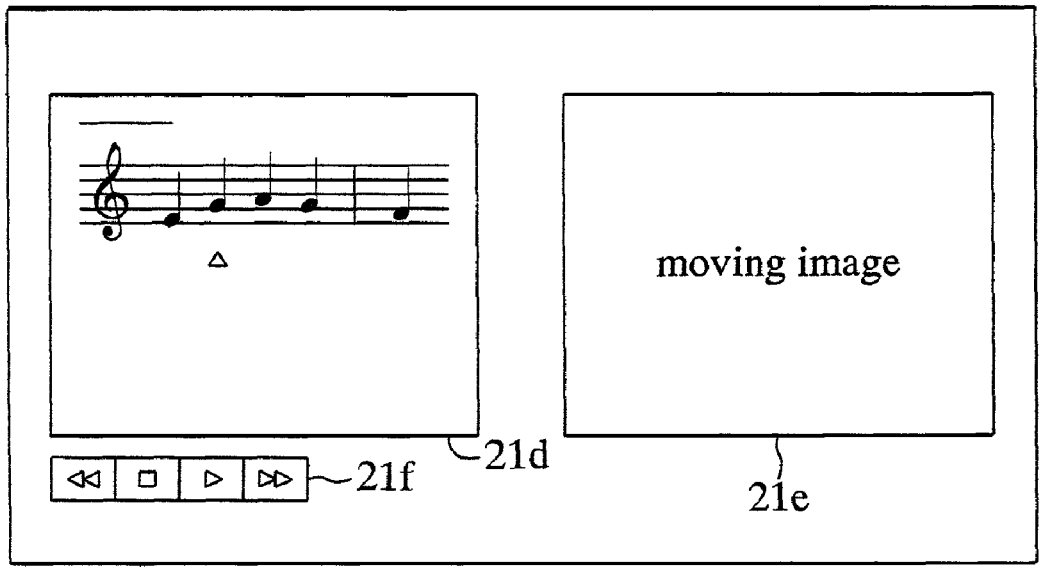
FIGS. 6(A) and (B) illustrate a screen of the display unit displaying other concrete example of musical content.

For example, when only musical score data is designated as an active material to have a reproduction controlling tool 21*f* (see the example of FIG. 3), as shown in FIG. 6(A) in which a musical score 21*d* and moving image 21*e* are displayed on the display unit 21, the reproduction controlling tool 21*f* is displayed close to the musical score 21*d* so as to correspond to the musical score 21*d*. In FIG. 6(A), the display of the musical score 21*d* and moving image 21*e* are instructed on the basis of the musical score designation data and video designation data contained in the content definition data, respectively. In addition, when the musical score data and video data are designated as content materials to be synchronously controlled by the reproduction controlling tool 21*f* (e.g. 1 of FIG. 3), the musical score 21*d* and moving image 21*e* shown in FIG. 6(A) are synchronously controlled in accordance with the instructions given by the reproduction controlling tool 21*f* as in the case of the first utilization mode. That is, the display of the musical score 21*d* progresses in synchronization with the display of the moving image 21*e*.

On the other hand, if designated as content materials to be synchronously controlled is musical score data and MIDI data (e.g. 2 of FIG. 3) in the state of FIG. 6(A), synchronously controlled in accordance with the instructions by the reproduction controlling tool 21*f* are the musical score 21*d* shown in FIG. 6(A) and an automatic performance as in the case of the first utilization mode. In this case, however, the moving image data does not follow the instructions given by the reproduction controlling tool 21*f*.

Figure 6B:
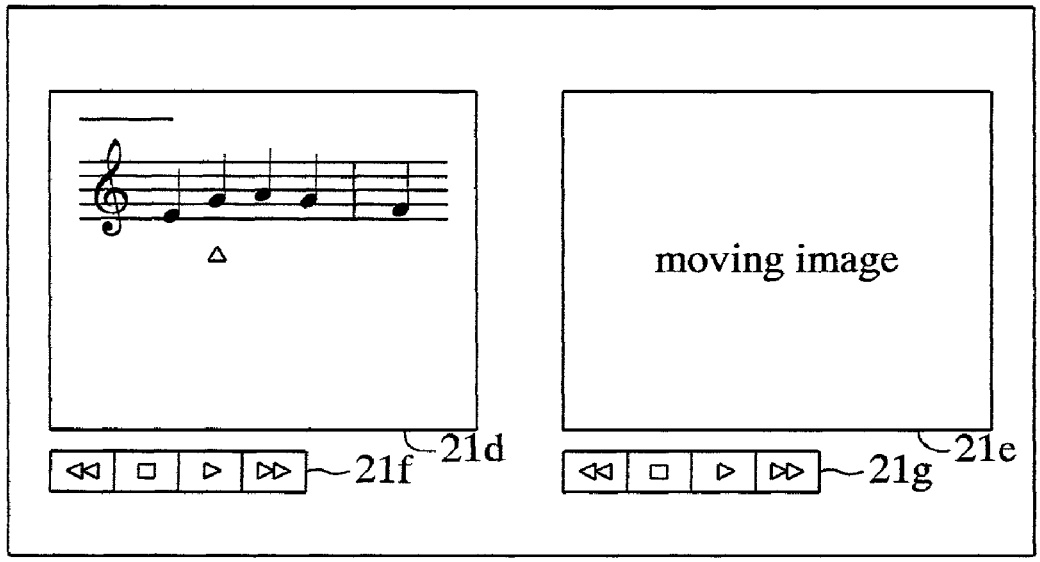

Instead of the above case, if the reproduction control plug-in data designates both the musical score data and moving image data as having a reproduction controlling tool respectively, the reproduction controlling tools 21*f* and 21*g* are displayed close to the musical score 21*d* and moving image 21*e*, respectively, on the display unit 21 as shown in FIG. 6(B). The reproduction controlling tools 21*f* and 21*g* are adapted to correspond to the musical score 21*d* and moving image 21*e*, respectively. In this case, content materials to be synchronously controlled by each of the reproduction controlling tools 21*f* and 21*g* are designated by material designation data which designates content materials to be synchronously controlled, the material designation data being contained in reproduction control plug-in designation data.

For example, if musical score data and MIDI data is designated as the content materials to be synchronously controlled by the reproduction controlling tool 21*f*, the musical score data and MIDI data is synchronously controlled by the reproduction controlling tool 21*f* as in the case of the first utilization mode. If video data is the only data designated as a content material to be synchronously controlled by the reproduction controlling tool 21*g*, only the video data is controlled by the reproduction controlling tool 21*g*.

In the above-described designation of content materials to be synchronously controlled by the reproduction controlling tool, the automatic selection of content material to be controlled by the reproduction controlling tools 21*f* and 21*g* displayed on the display unit 21 is achieved just by including, in content definition data, an instruction to display a content material (video designation data, image designation data, etc.) and an instruction to display a reproduction controlling tool (content material designation data for which a reproduction controlling tool is displayed). Therefore, the automatic selection facilitates selective instruction to reproduce a content material.

Furthermore, just by including in the content definition data an instruction to designate content materials to be synchronously controlled (material designation data to be synchronously controlled) in addition to the instruction to display the reproduction controlling tool, the synchronous control over a plurality of content materials by a reproduction controlling tool is achieved in an easy manner, improving the usability of the musical content utilizing apparatus.

Above-described is an embodiment of the present invention, however, in carrying out the present invention, it will be understood that the present invention is not limited to the above-described embodiment, but various modifications may be made without departing from the spirit and scope of the invention.

In the above embodiment, for example, the plug-in programs are used for delivering content materials to the user, however, at least part of content materials may be delivered to the user by a fundamental control program. In this case, for instance, fundamental control programs may include a sequencer program for reproducing MIDI data.

In addition, although the above embodiment employs an electronic musical instrument having the keyboard 31 as the musical content utilizing apparatus according to the present invention, the present invention may be applicable to musical content utilizing apparatuses having any configuration as far as the musical content utilizing apparatuses are capable of utilizing musical content. Examples of the applicable musical content utilizing apparatuses include electronic musical instruments without the keyboard 31 and various electronic musical apparatuses with a built-in computer such as sequencers and rhythm machines. Various portable terminals such as personal computers, PDAs, mobile phones may also be applicable as the musical content utilizing apparatus.

Furthermore, the musical content utilizing apparatus may not include all of the display unit 21, tone generator 22 and audio signal reproduction circuit 23 which the above embodiment includes, but may have only part of them. Moreover, the musical content utilizing apparatus may include different utilization capabilities.

What is claimed is:

1. A musical content utilizing apparatus comprising:

a display unit;

a content utilization portion for providing a user with musical information on the display unit based on content material data;

an input portion for inputting a musical content package containing content definition data and different kinds of content material data for displaying an image on the display unit, the content definition data defining the handling of the content material data used by the content utilization portion among the different kinds of content material data, the content definition data including content material designation data for designating any one or more of the different kinds of content material data included in the musical content package, for using the designated content material data by the content utilization portion; and a filtering portion for filtering the different kinds of content material data contained in the musical content package input at the input portion to extract applicable content material data from among the different kinds of content material data and deleting the content material designation data associated with the inapplicable content material data, wherein the different kinds of content material data include musical score data, MIDI data, audio data, image data, and video data, and wherein the content utilization portion processes the input musical content package and provides the user with musical information on the display unit based on the applicable content material data extracted by the filtering portion and the content material designation data associated with the extracted applicable content material data.

2. A musical content utilizing apparatus according to claim 1, further comprising a stylesheet storage portion for storing a stylesheet that defines content material data applicable to the content utilization portion, wherein the filtering portion filters the input different kinds of content material data in accordance with the stylesheet stored in the stylesheet storage portion.

3. A musical content utilizing apparatus according to claim 2, wherein the stylesheet stored in the stylesheet storage portion is upgradable.

4. A computer-readable medium storing a computer program for a musical content utilizing apparatus for providing a user with musical content and having a display unit, the computer program including:

a content utilization instruction for providing a user with musical information based on content material data;

an input instruction for inputting a musical content package containing content definition data and different kinds of content material data for displaying an image on the display unit, the content definition data defining the handling of the content material data used in the utilization instruction among the different kinds of content material data, the content definition data including content material designation data for designating any one or more of the different kinds of content material data included in the musical content package, for using the designated content material data in the content utilization instruction; and a filtering instruction for filtering the different kinds of content material data contained in the musical content package input at the input instruction to extract applicable content material data from among the different kinds of content material data and deleting the content material designation data associated with the inapplicable content material data, wherein the different kinds of content material data include musical score data, MIDI data, audio data, image data, and video data, and wherein the content utilization instruction processes the input musical content package and provides the user with musical information on the display unit based on the applicable content material data extracted in the filtering instruction and the content material designation data associated with the extracted applicable content material data.

5. A computer-readable medium according to claim 4, wherein the filtering instruction filters the input different kinds of content material data in accordance with a stylesheet that defines the content material data applicable to the utilization instruction, the stylesheet being stored in a memory of the musical content utilizing apparatus.

6. A computer-readable medium according to claim 5, wherein the stylesheet stored in the memory is upgradable.

* * * * *